US009469507B2

(12) United States Patent
Awerbuch et al.

(10) Patent No.: US 9,469,507 B2
(45) Date of Patent: Oct. 18, 2016

(54) MODULAR ESCALATING WHEELCHAIR LIFT

(71) Applicant: Drexel University, Philadelphia, PA (US)

(72) Inventors: Jonathan Awerbuch, Media, PA (US); Jordan Berman, Havertown, PA (US); Steve Eggert, Mt. Ephraim, NJ (US); Nicholas Raiser, Liberty Corner, NJ (US); Giancarlo Migliuolo, Pittsburgh, PA (US)

(73) Assignee: Drexel University, Philadelphia, PA (US)

( * ) Notice: Subject to any disclaimer, the term of this patent is extended or adjusted under 35 U.S.C. 154(b) by 0 days.

(21) Appl. No.: 14/720,828

(22) Filed: May 24, 2015

(65) Prior Publication Data

US 2015/0375965 A1 Dec. 31, 2015

Related U.S. Application Data

(60) Provisional application No. 62/002,940, filed on May 26, 2014, provisional application No. 62/164,043, filed on May 20, 2015.

(51) Int. Cl.
*B66B 9/08* (2006.01)

(52) U.S. Cl.
CPC ..... *B66B 9/08* (2013.01); *B66B 9/0815* (2013.01); *B66B 9/0846* (2013.01)

(58) Field of Classification Search
CPC ..... B66B 9/08; B66B 9/0815; B66B 9/0846
USPC ..... 187/201, 245
See application file for complete search history.

(56) References Cited

U.S. PATENT DOCUMENTS 1,358,062 A * 11/1920 Davis ..... B66B 9/083 187/201
2,832,436 A * 4/1958 Roberts ..... B62B 5/02 187/201
2,847,131 A * 8/1958 Miller ..... B66F 9/07 187/221
3,104,112 A 9/1963 Crail
3,216,369 A * 11/1965 McKinney ..... B66B 9/083 104/176
3,277,978 A * 10/1966 Stone, Jr. ..... E04H 6/065 104/44
3,500,963 A * 3/1970 Beutler ..... B66B 9/083 187/201
3,716,158 A * 2/1973 Hansen ..... B66F 9/149 187/236
3,869,011 A 3/1975 Jensen (Continued)

OTHER PUBLICATIONS http://www.ameriglide.com/incline-platform-lifts.htm?ref=navside.

(Continued)

*Primary Examiner* — Michael Riegelman
(74) *Attorney, Agent, or Firm* — Joseph E. Maenner; Maenner & Associates, LLC

(57) ABSTRACT

A modular lift system that can be mounted on a stairway is disclosed. The system includes forks located on a first floor onto which the user rolls their wheelchair. The forks are motor operated to traverse a toothed track between the first floor and a second floor with the wheelchair and the user riding the forks. When the forks reach the second floor, the user rolls the wheelchair off the forks.

17 Claims, 9 Drawing Sheets

(56) References Cited

U.S. PATENT DOCUMENTS 4,026,388 A * 5/1977 Creissels ..... B66B 9/06 187/245
4,345,669 A * 8/1982 Noall ..... B66B 9/083 182/103
4,627,517 A 12/1986 Bor
5,050,708 A * 9/1991 Wood ..... B66B 9/0838 187/201
5,052,521 A 10/1991 Wendt et al.
5,105,741 A * 4/1992 Leary ..... E01B 23/00 104/106
5,125,481 A * 6/1992 Shibata ..... B66B 9/00 187/245
5,217,089 A 6/1993 Virk
5,230,405 A * 7/1993 Bartelt ..... B66B 9/0815 187/201
5,476,156 A * 12/1995 Gerber ..... B66B 9/193 187/201
5,489,181 A * 2/1996 Greaves ..... B64F 1/30 414/398
6,105,726 A 8/2000 Taylor et al.
6,484,829 B1 11/2002 Cox
6,739,430 B2 5/2004 Hill
7,325,654 B2 * 2/2008 Stanislao ..... B66B 9/083 187/201
7,395,900 B2 * 7/2008 Murray ..... B66B 9/0869 187/200
7,413,057 B2 8/2008 Ellison, Jr. et al.
7,954,602 B2 * 6/2011 Stanislao ..... B66B 9/083 187/200
8,146,713 B2 * 4/2012 Rosenthal ..... B66B 9/083 187/200
2002/0098077 A1 7/2002 Beech
2003/0146055 A1 * 8/2003 Hill ..... B66B 9/06 187/245
2005/0150064 A1 7/2005 Hill
2006/0038360 A1 2/2006 Negishi
2009/0000035 A1 * 1/2009 Awerbuch ..... A61G 1/013 5/627
2012/0261216 A1 * 10/2012 Hrenchir ..... B66B 9/0846 187/201
2013/0299280 A1 * 11/2013 Friedrich ..... B64D 11/0007 187/245
2014/0124293 A1 * 5/2014 Eversole ..... B66F 3/02 182/103

OTHER PUBLICATIONS http://ezlivingconcepts.com/.

* cited by examiner

MODULAR ESCALATING WHEELCHAIR LIFT

CROSS-REFERENCE TO RELATED APPLICATION

The present application claims priority from U.S. Provisional Patent Application Ser. No. 62/002,940, which was filed on May 26, 2014, and from U.S. Provisional Patent application Ser. No. 62/164,043, which was filed on May 20, 2015, both of which are incorporated herein by reference in their entireties.

BACKGROUND OF THE INVENTION

Wheelchair-bound people who desire to move between floors in their homes typically use a moving seat that rides along a rail between the two floors. The use of this seat, however, requires the person to exit their wheelchair, leaving the wheelchair behind on the first floor, and also requiring a second wheelchair to be available on the second floor when the person arrives there. The user must then transition from the seat to the second wheelchair. Alternatively, for the user to remain in a single wheelchair, a large, expensive elevator or lift must be installed to transport both the wheelchair and the user between the two floors, which requires a substantial amount of floor space that is not available in a typical home.

It would be beneficial to provide a wheelchair lift system that allows the user to remain in the wheelchair, to transport both the user and the wheelchair between floors, and to not require a substantial amount of space in the home.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Briefly, the present invention provides a modular lift system that can be mounted on a stairway. The system includes forks located on a first floor onto which the user rolls their wheelchair. The forks are motor operated to traverse a toothed track between the first floor and a second floor with the wheelchair and the user riding the forks. When the forks reach the second floor, the user rolls the wheelchair off the forks.

Other features of the present invention will become apparent from the present description and drawings.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
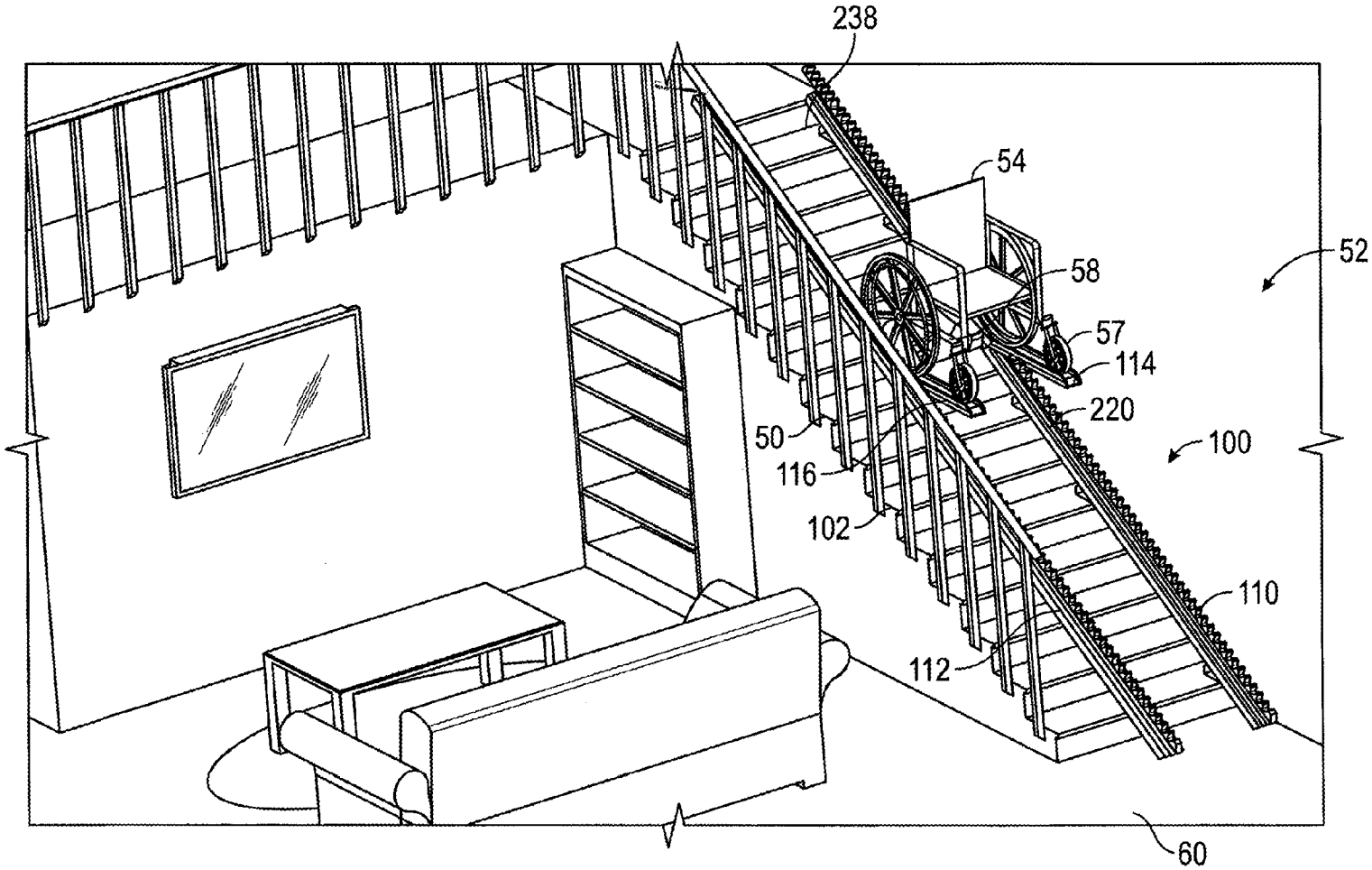
FIG. 1 is a perspective view of a modular escalating wheelchair lift assembly according to an exemplary embodiment of the present invention having been installed on a flight of stairs.

In the drawings, like numerals indicate like elements throughout. Certain terminology is used herein for convenience only and is not to be taken as a limitation on the present invention. The terminology includes the words specifically mentioned, derivatives thereof and words of similar import. As used herein, the term "coupled end" means an end of a fork that is slidingly attached to a rail and "free end" means an end of the fork that is distal from the rail. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Referring now to the Figures in general, a modular escalating wheelchair lift 100 according to an exemplary embodiment of the present invention is shown. Lift 100 is used to raise and lower an occupied wheelchair up and down a flight of stairs. The stairs can be located in a residence, an office, or other location with more than one vertical level. While the present invention is primarily directed to a system that is used to raise and lower an occupied wheelchair up and down a flight of stairs, those skilled in the art will recognize that the present invention can also be used to lift any other object of an appropriate size up and down between two different vertical heights.

As shown in FIG. 1, lift 100 uses two parallel rail assemblies 110, 112 that are installed along the length of a flight of stairs 50. Rail assembly 110 is fixedly mounted to stairs 50, such as along a wall 52. Rail assembly 112, however, is adjustable along the width of stairs 50 to accommodate the wheelbase of a wheelchair 54. Forks 114, 116 ride along rail assemblies 110, 112, respectively. Wheelchair 54 is ridden onto forks 114, 116. Lift 100 is then activated to raise or lower forks 114, 116, along with wheelchair 54, up or down stairs 50.

Figure 2:
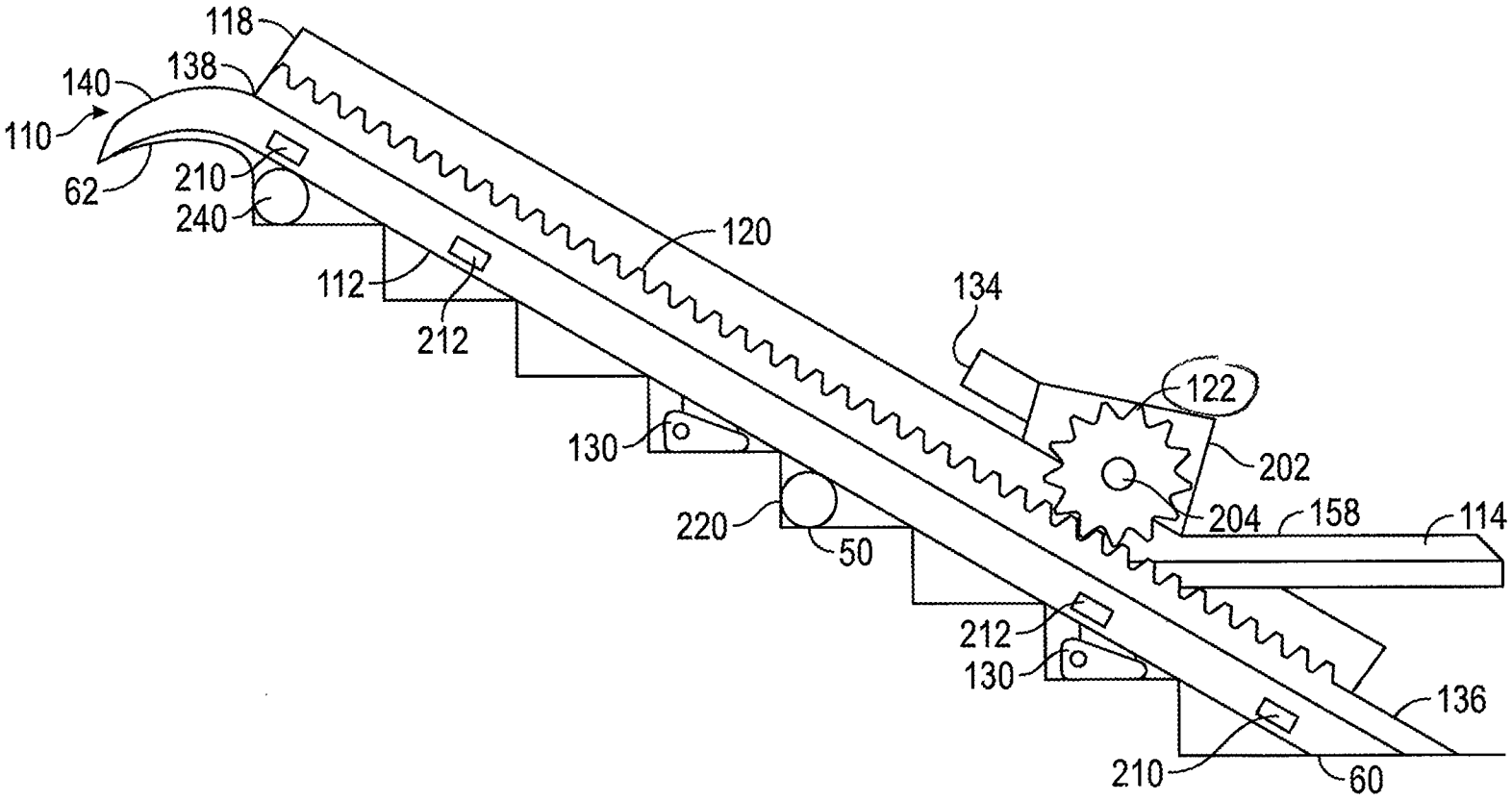
FIG. 2 is a side elevational view of a rail assembly used on the assembly of FIG. 1.

FIG. 2 shows a side elevational view of rail assembly 110 with its associated fork 114. Those skilled in the art will recognize that rail assembly 112 and its associated fork 116 are generally mirror images of rail assembly 110 and fork 114, and do not have to be described in detail.

Figure 3:
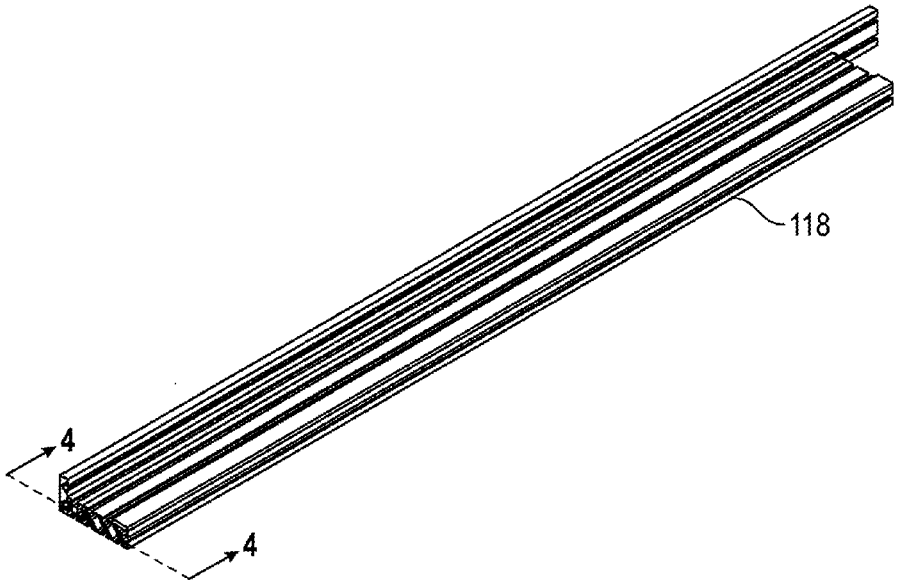
FIG. 3 is a perspective view of a rail used with the rail assembly of FIG. 2.
Figure 4:
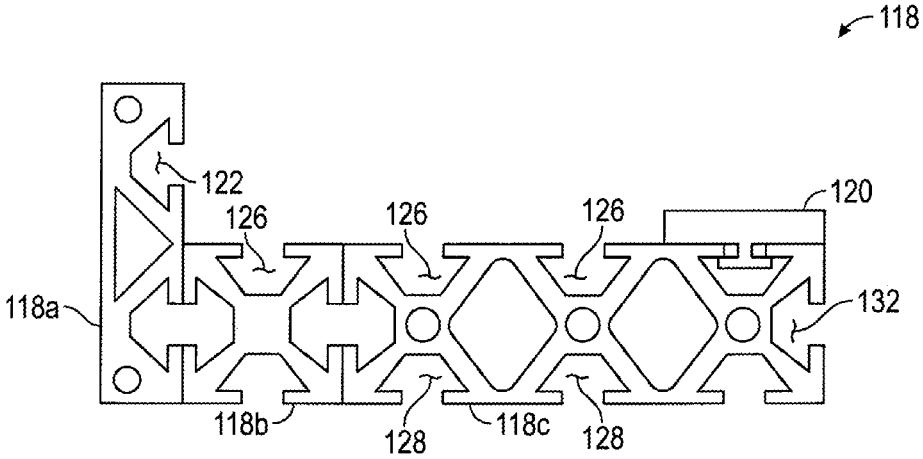
FIG. 4 is a sectional view of the rail taken along lines 4-4 of FIG. 3.
Figure 4A:
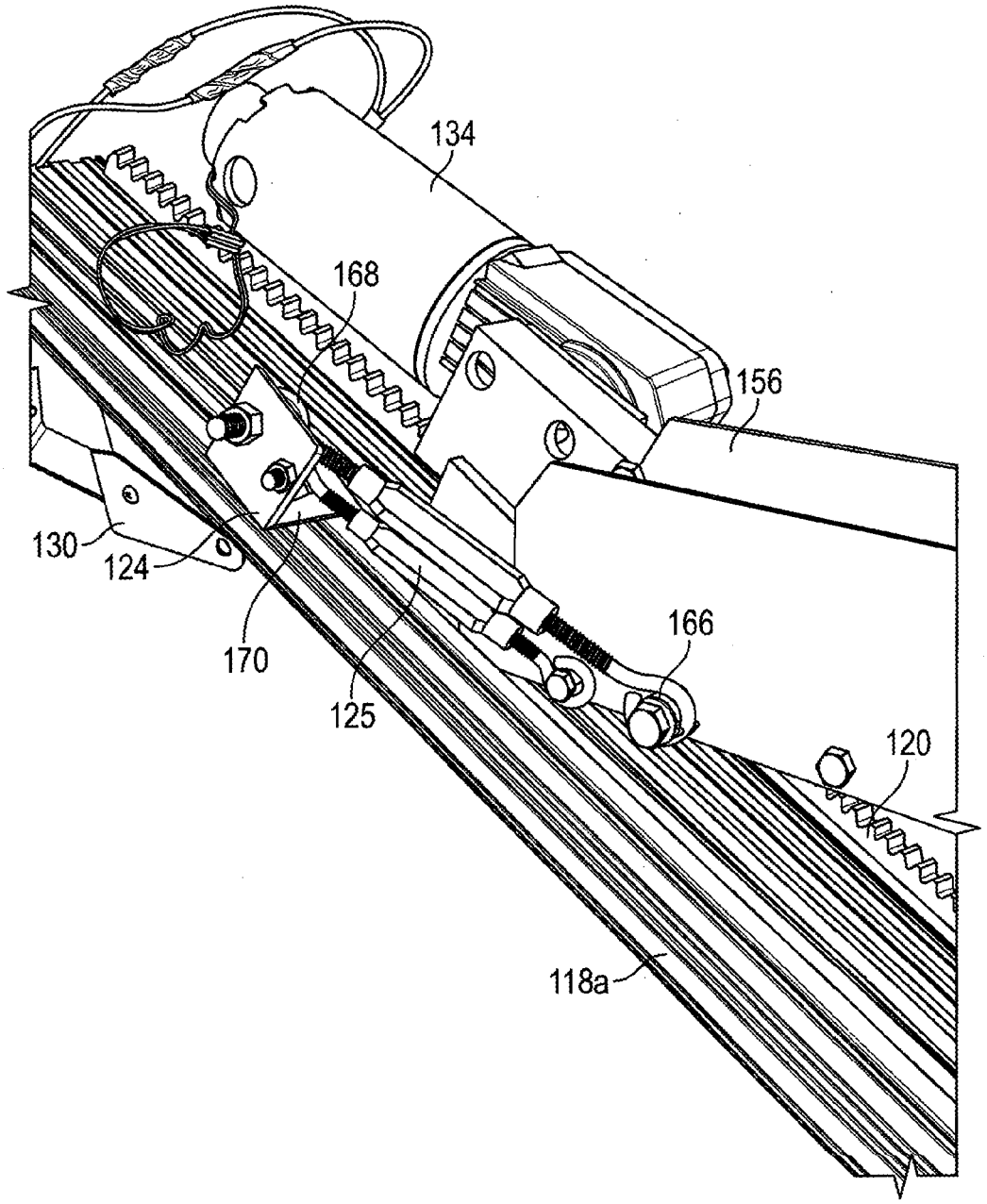
FIG. 4A is a perspective view of a tie rod used to link the rail shown in FIG. 3 with the fork shown in FIG. 1.

Rail assembly 110 includes a rail 118 that supports a linear toothed rack 120 on which a toothed gear 122 rolls. Rail 118 is constructed from extruded aluminum "80/20 T-slotted" channels and has a generally "L-shaped" transverse cross section, as shown in FIGS. 3 and 4. While rail 118 is shown in FIG. 4 as having three connected pieces 118*a*, 118*b*, 118*c*, those skilled in the art will recognize that rail 118 can be a single piece. Side element 118*a* includes a channel 122 that faces inward, generally toward piece 118*c*. Channel 122 is used to guide a rail end 168 of a tie rod 125 (shown in FIG. 4A), that provides vertical support to fork 114.

Base elements 118*b*, 118*c* each include at least one upward vertically facing channel 126 that is used to support and guide fork 114 as fork 114 travels along the length of rail 118. In an exemplary embodiment, three of the channels 126 are used to guide fork 114, although those skilled in the art will recognize that more or less than three channels 126 can be used. Base elements 118*b*, 118*c* also include at least one downward vertically facing channel 128 that can be used to secure adjustable feet 130 (shown in FIG. 1) to rail 118. Base element 118*c* also includes a side channel 132 that is used to mount a fork-operating motor 134 and to allow motor 134 to ride along rail 118 with fork 114.

A bottom end 136 of rail 118 can be beveled to provide a generally planar contact face with a floor 60. A top end 138 of rail 118 can include a ramp 140 that over hangs a top stair 62 to provide a smooth transition of wheelchair 54 between fork 114 and top stair 62.

Because all stairs do not have the same slope, rail 114 includes adjustable feet 130, as shown in FIG. 2. Feet 130 are mounted to an underside of rail 118. Feet 130 can be spaced at lengths along rail 118 as desired by a user.

Figure 5:
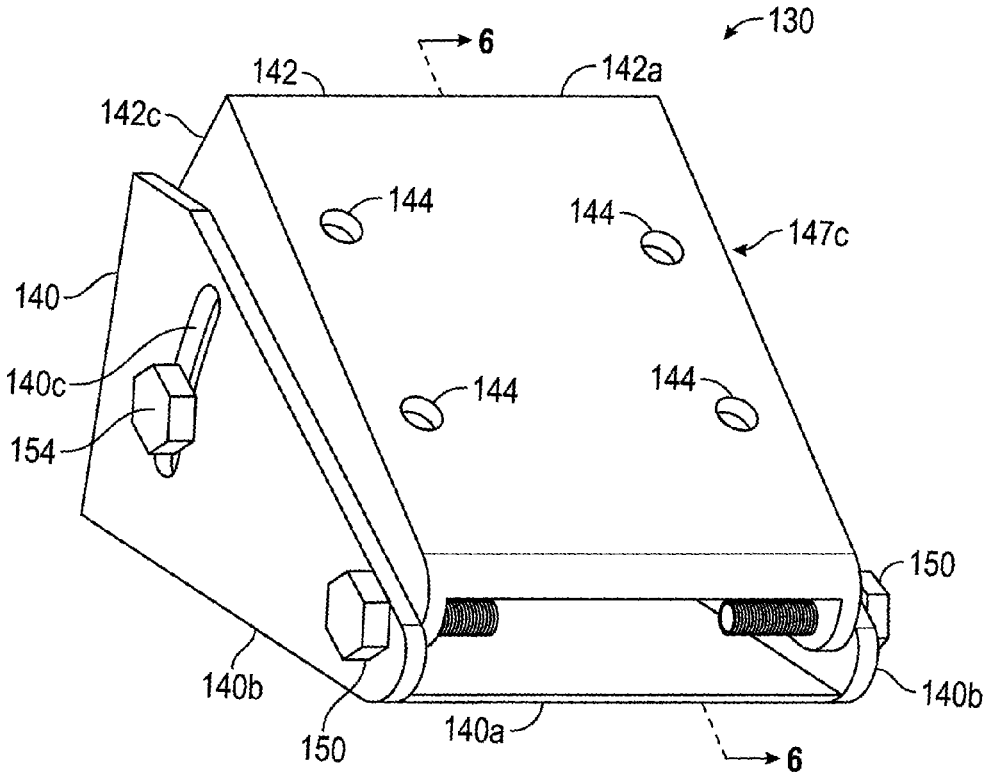
FIG. 5 is a perspective view of an adjustable foot used with the rail shown in FIG. 2.
Figure 6:
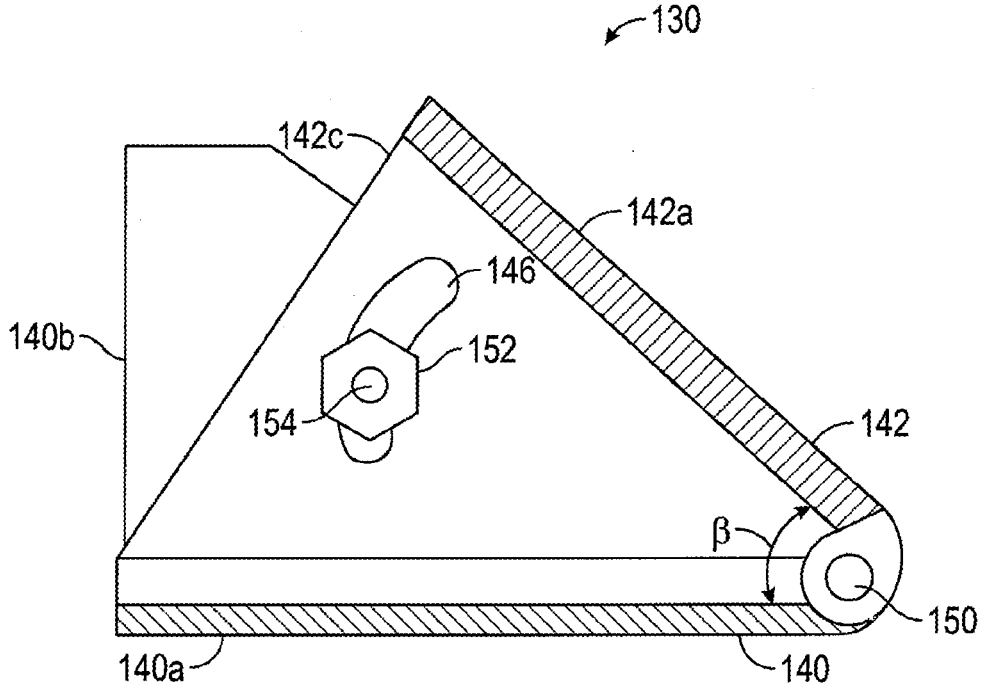
FIG. 6 is a sectional view of the foot taken along lines 6-6 of FIG. 5.

As shown in FIGS. 5 and 6, each foot 130 includes a stair engaging portion 140 and a base engaging portion 142. Stair engaging portion 140 has a generally U-shaped cross section with a rectangular base 140*a* and generally triangular side walls 140*b*. Each side wall 140*b* includes an arcuate through-opening 140*c*.

Base engaging portion 142 has a generally U-shaped cross section that is narrower than that of stair engaging portion 140 such that base engaging portion 142 fits between side walls 140*b* of stair engaging portion 140. Base engaging portion 142 has a generally rectangular base 142*a* having a plurality of through-holes 144 that allow base engaging portion 142 to be releasably coupled to rail 118, such as by tee bolts (not shown). Tee bolts are inserted into downward vertically facing channels 128 in base elements 118*b*, 118*c* and through through-holes 144. Base engaging portion 142 also includes generally triangular side walls 142*c*. Each triangular side wall 142*c* also has a generally arcuate through-opening 146 that aligns with a corresponding arcuate through-opening 140*c* in stair engaging portion 140.

Stair engaging portion 140 is pivotally coupled to base engaging portion 142 via securing members, such as, for example, bolts 150. An angle β between stair engaging portion 140 and base engaging portion 142 can be adjusted by pivoting stair engaging portion 140 relative to base engaging portion 142 about securing members 150. The angle β can be releasably secured by inserting a fastening member, such as a nut 152 and bolt 154, through arcuate through-openings 140*c*, 146 and tightening fastening members 152, 154 against side walls 140*b*, 142*c*.

Figure 7:
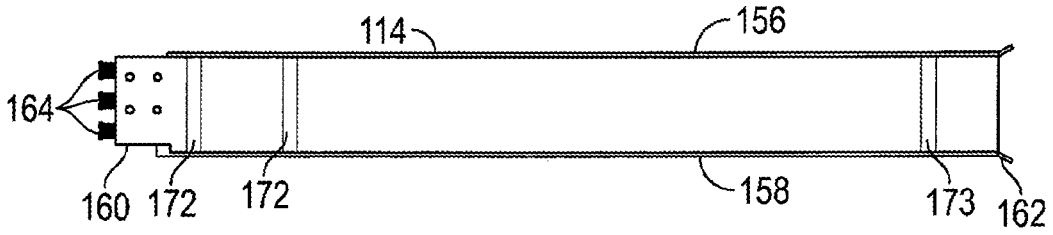
FIG. 7 is a top plan view of a fork used in the assembly of FIG. 1.
Figure 7A:
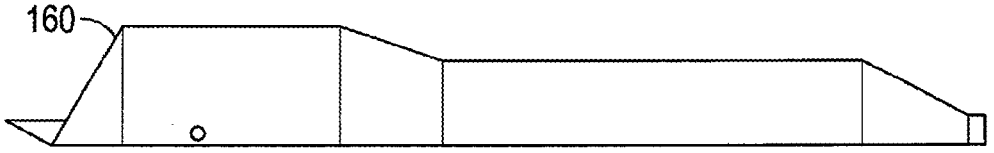
FIG. 7A is a side elevational view of the fork shown in FIG. 7.
Figure 8:
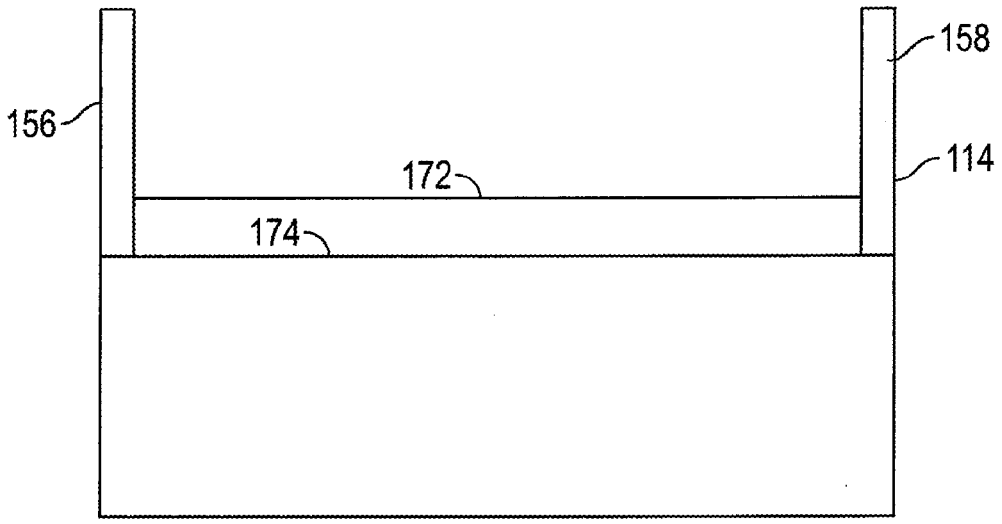
FIG. 8 is a sectional view of the fork shown in FIG. 7.

Referring now to FIGS. 7 and 8, fork 114 is a generally planar elongate member, with a pair of side walls 156, 158 extending generally the length thereof. Fork 114 has a coupled end 160 that is coupled to rail assembly 110 and a free end 162, located distal from coupled end 160. In an exemplary embodiment, fork 114 has a width of about three (3) inches to accommodate the width of a rear wheel 58 on wheel chair 54, although those skilled in the art will recognize that fork 114 can have different widths. Each side wall 156, 158 flares generally outwardly at free end 162, to provide a "cattle chute" that guides rear wheel 58 onto fork 114 when fork 114 is on the floor 60 and wheelchair 54 is being backed onto fork 114.

Coupled end 160 of fork 114 includes a plurality of bearing surfaces 164 that are slidably engaged with upward vertically facing channels 126 in base elements 118*b*, 118*c*. In an exemplary embodiment, bearing surfaces 164 are constructed from nylon, Delrin®, Teflon®, or other low friction material. Bearing surfaces 164 have a generally t-shaped cross-section so that bearing surfaces 164 are retained within channels 126.

Tie rod 125 has a first end 166 fixedly connected to side wall 156. First end 166 of tie rod 125 is located at an approximate location where rear wheel 58 rests on fork 114 to provide vertical support of fork 114 when the weight of wheelchair 54 and user are on fork 114 and fork 114 is not resting on floor 60. A second, or rail, end 168 of tie rod 125 includes a bearing surface 170 that is slidably inserted into channel 122 in side element 118*a*. Similar to bearing surfaces 164, bearing surface 170 can be constructed from nylon, Delrin®, Teflon®, or other low friction material. Bearing surface 170 has a generally t-shaped cross-section so that bearing surface 170 is retained within channel 122. As fork 114 moves along rail assembly 110, second end 168 of tie rod 125 slides along channel 122.

Speed bumps 172, 173 are used on the top surface 174 of fork 114 to provide stops for the wheels 58, 59 of wheelchair 54 and to restrict wheelchair 54 from rolling off forks 114, 116 while lift 100 is in operation. In an exemplary embodiment, two rear wheel speed bumps 172 are located toward a coupled end 160 of fork 114, while a single front wheel speed bump 173 is located toward a free end 162 of fork 114. Rear wheel speed bumps 172 and forward wheel speed bump 173 are spaced so that, when wheelchair 54 is on forks 114, 116, the rear wheel 58 of wheelchair 54 is located between rear wheel speed bumps 172 and the front wheel 59 of wheelchair 54 is located on the coupled end side of front wheel speed bump 173.

Figure 9:
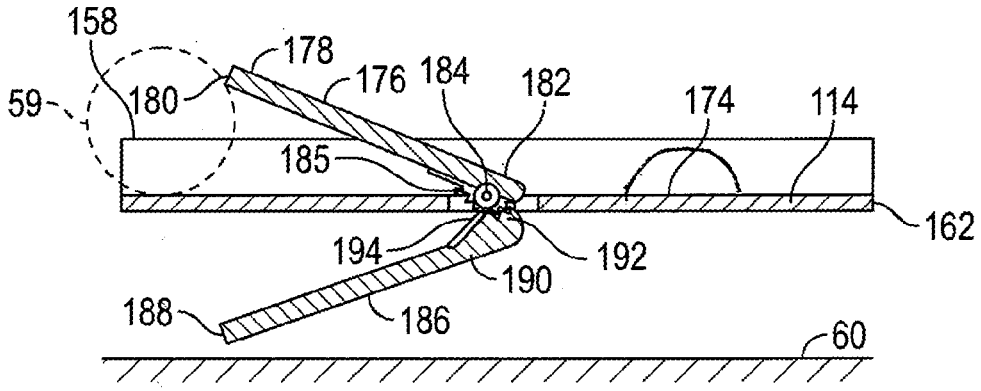
FIG. 9 is a sectional view of an exemplary embodiment of a wheel stop in a raised position.
Figure 10:
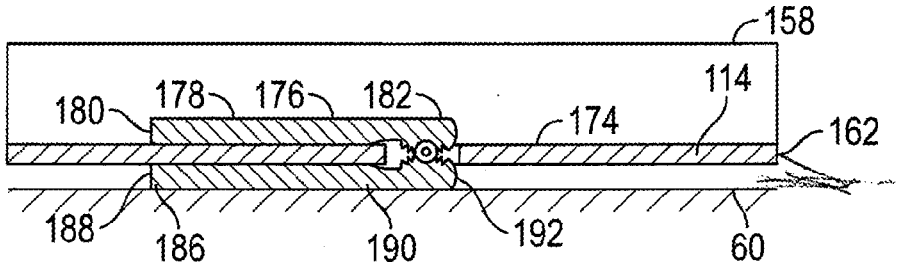
FIG. 10 is a sectional view of the wheel stop of FIG. 9 in a retracted position.

Alternatively, as shown in FIGS. 9 and 10, a biased positive stop 176 can be mounted on free end 162 of fork 114. Positive stop 176 is located between front wheel 59 and free end 162 of fork 114 to restrict front wheel 59 from rolling off free end 162 of fork 114 when fork 114 is off of the floor 60.

Positive stop 176 includes an upper plate 178 that extends above top surface 174 of fork 114. Upper plate 178 has a wheel engaging end 180 and a pivot end 182. Pivot end 182 is pivotally coupled to fork 114, such as through side walls 156, 158 of fork 114 via a pivot pin 184. Pivot end 182 also includes a first toothed gear 185. Positive stop 176 also includes a lower plate 186 that extends below fork 114. Lower plate 186 has a floor engaging end 188 and a pivot end 190. Pivot end 190 can be pivotally coupled along the same axis as pivot end 182 of upper plate 178. Pivot end 190 also includes a second toothed gear 192 that is engaged with first toothed gear 184. A biasing member 194, such as, for example, a torsion spring, is wrapped around pivot pin 184 with its ends engaging upper plate 178 and lower plate 186, respectively, to bias wheel engaging end 180 away from floor engaging end 188.

When fork 114 is in the air, such as when lift 100 is above the floor 60 (as shown in FIG. 9), biasing member 194 biases wheel engaging end 180 upward, away from fork 114, and floor engaging end 188, downward, also away from fork 114. Wheel engaging end 180 extends sufficiently high from fork 114 to restrict front wheel 59 from rolling over wheel engaging end 180.

As fork 114 approaches floor 60, floor engaging end 188 engages floor 60, forcing floor engaging end 188 toward fork 60. Second toothed gear 192 rotates about its axis, and the engagement of second toothed gear 192 with first toothed gear 184 rotates first toothed gear 184 so that upper plate 178 also pivots its axis, lowering wheel engaging end 180 of upper plate 178 downward, toward the top of fork 114 (as shown in FIG. 10), allowing front wheel 59 to roll over upper plate 178 and off the free end 162 of fork 114.

Referring back to FIG. 2, an electric motor 134 powers fork 114 to move up and down rail 118. Electric motor is DC operated and is bi-directional. As shown in FIG. 2, electric motor 134 is coupled to a bracket 202, which in turn is coupled to side wall 158 of fork 114. Bracket 202 is also slidingly engaged with channel 132 in rail 118 to take a portion of the weight of motor 132 and bracket 202.

Electric motor 134 also has an output shaft 204 that is coupled to gear 122. As output shaft 204 rotates, gear 122 rotates. The engagement of gear 122 with rack 120 drives gear 122 up and down rack 120, depending on the direction of rotation of output shaft 204. Because motor 134 is coupled to fork 114, the rotation of gear 122 up and down rack 120 also drives fork 114 up and down rack 120. Motor 134 is mounted to fork 114 such that the weight of fork 114 is on one side of gear 122 and the weight of motor 134 is on an opposing side of gear 122, providing a counter-balance effect.

Rail sensors 210, 212 are mounted on rail assembly 110 and are used to slow down and stop motor 134 when forks 114, 116 are at predetermined locations along stairs 50. A first rail sensor 210 is located at the top of stairs 50 to stop motor 134 and fork 114 when fork 114 gets to the top of stairs 50. Similarly, a second rail sensor 210 is located at the bottom of stairs 50, proximate to floor 60, to stop motor 134 and fork 114 when fork 114 gets to floor 60.

A third rail sensor 212 is located along rail assembly 110 a predetermined distance from the top of stairs 50. Third rail sensor 212 is used to transmit a signal to motor 134 that fork 114 is close to the top of stairs 50, and to begin to slow down. Similarly, a fourth rail sensor 212 is located along rail assembly 110 a predetermined distance from the bottom of stairs 50. Fourth rail sensor 212 is used to transmit a signal to motor 134 that fork 114 is close to the bottom of stairs 50, and to begin to slow down.

Figure 11:
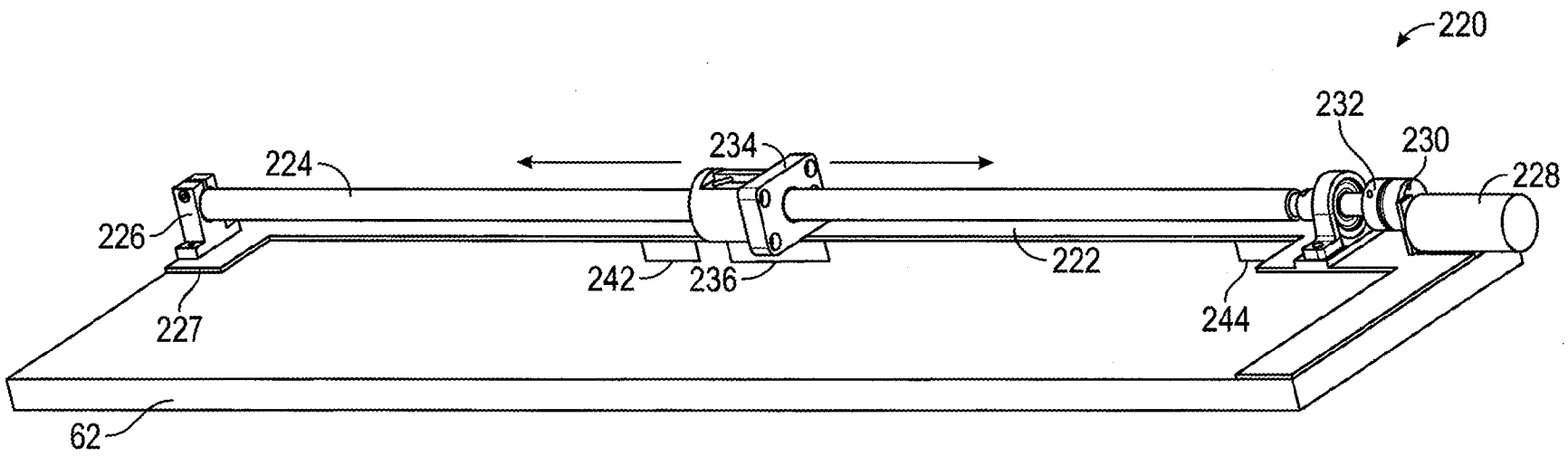
FIG. 11 is a perspective view of a screw assembly used in the assembly of FIG. 1.

As discussed above, rail assembly 112 is adjustable along the width of stairs 50 to accommodate the wheelbase of wheelchair 54. As shown in FIG. 1, a motorized screw assembly 220 is located along the length of rail assembly 110, approximately half way up stairs 50. Screw assembly 220 extends across the length of a stair tread 62. As shown in FIG. 11, in an exemplary embodiment, screw assembly 220 includes a threaded screw portion 222 and a non-threaded telescoping portion 224 to allow screw assembly 220 to extend the full length of stair tread 62 so that an end portion 226 of telescoping portion 224 is against the end of stair tread 62 and is less likely to be trod on or tripped on by a person walking up stairs 50. An end footer 227 is fixed to end portion 226 of telescoping portion 224 and supports a distal end (away from rail assembly 110) of screw assembly 220.

A proximal end of screw assembly 220 includes a screw motor 228 that is electrically powered. Screw motor 228 can be located under rail assembly 110 to keep screw motor 228 out of the way of persons walking up/down stairs 50. An output shaft 230 of screw motor 228 is attached to a worm drive 232, which rotates screw portion 222. A guide 234, mounted on screw portion 222, traverses along stair tread 62 as screw portion 222 rotates. Rail assembly 112 is fixed to guide 234 (not shown in FIG. 11) and traverses along stair tread 62 as screw portion 222 rotates, moving rail assembly 112 away from rail assembly 110 when lift 100 is about to be used, and toward rail assembly 110 after lift 100 has been used. Guide 234 includes a slider foot 236 disposed on a bottom surface thereof. Slider foot 236 can be constructed from nylon, Delrin®, Teflon® or other low-friction material to reduce friction as guide 234 slides across stair tread 62. Alternatively, although not shown, instead of a slider foot 236, a roller or ball can be used to further reduce friction.

A limit switch 242 can be mounted on screw assembly 220 to stop screw motor 220 when guide 234 has traveled a desired distance along screw portion 222. Limit switch 242 can be manually positioned along screw assembly 220 to accommodate wheelchairs of varying wheelbases. Once limit switch 242 is set at a desired location, rail assembly 112 will travel along screw portion 222 until rail assembly 112 engages limit switch 242, at which rail assembly 112 stops. Another limit switch 244 is located proximate to worm drive 232 such that, when rail assembly 112 is being returned to a stowage position alongside rail assembly 110, rail assembly 112 engages limit switch 244 and stops at the stowage position.

An upper guide rail 238 (shown in FIG. 1) is mounted proximate to the top stair and extends the length of the stair. Guide rail 238 can be constructed from a strip of 80/20 T-slotted channel. Rail assembly 112 is slidably mounted on guide rail 238, such as with a low friction bearing surface such as nylon, Delrin®, Teflon®, or other low friction material to assist in the sliding of rail assembly 112 between an operating position in which rail assembly 112 and rail assembly 110 are separated from each other by the wheelbase of wheelchair 54 and a stowage position in which rail assembly 112 is stowed alongside rail assembly 110.

Figure 12:
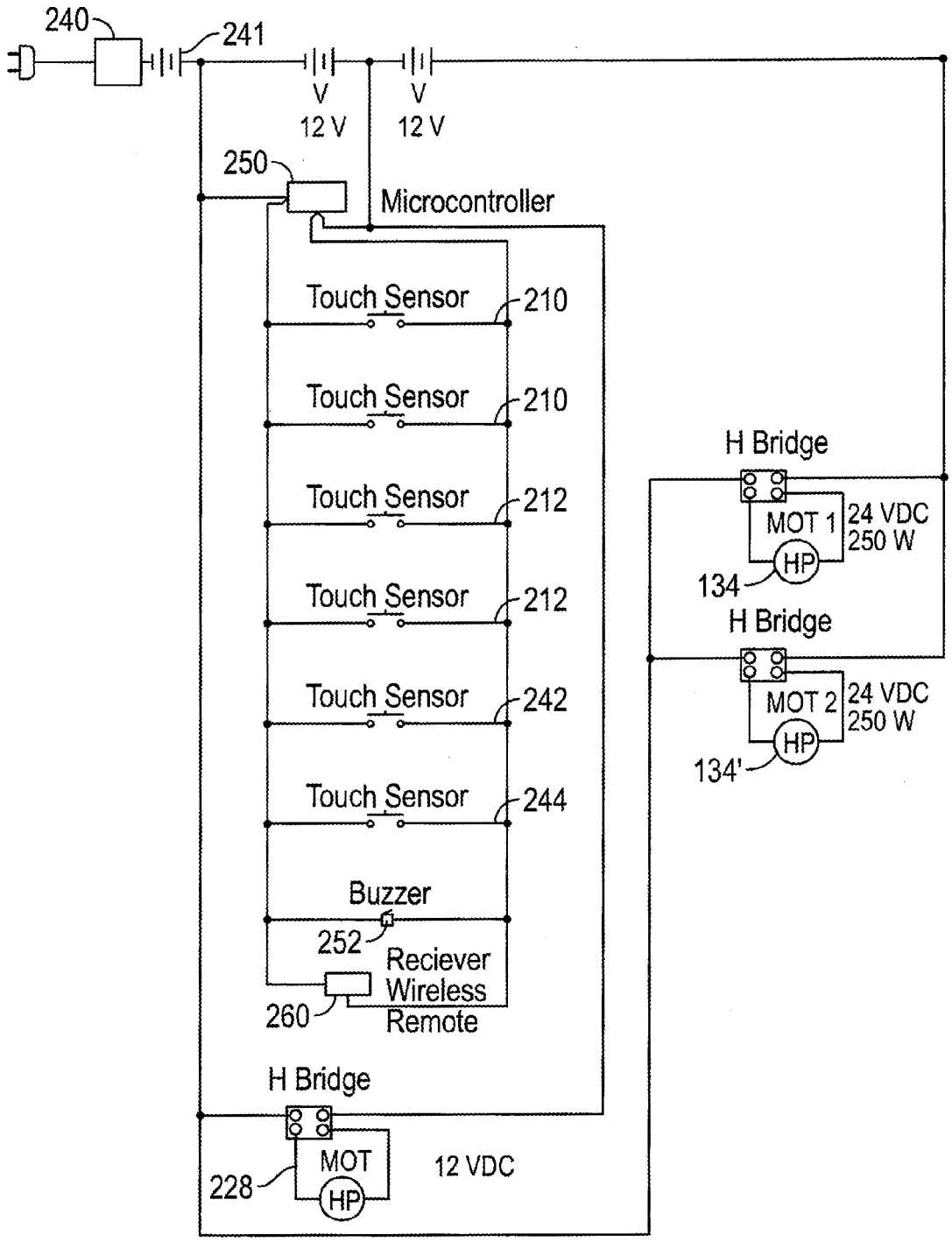
FIG. 12 is an electrical schematic drawing showing an exemplary electrical system for the rail assembly of FIG. 1.

Electrical power to operate lift 100 can be provided from a standard 110 volt alternating current ("AC") electrical outlet or other 110 volt electrical supply. As shown in the electrical schematic of FIG. 12, the electrical supply is provided to a transformer 240 that transforms provided electrical power from 110 volts AC to 24 volts direct current ("DC"). The 24 volts DC is provided to a battery 241 that is used to provide electrical power to fork-lifting motors 134, 134', screw motor 228, and sensors 210, 212 and limit switches 242, 244. Battery 241 provides an electrical back-up to power lift 100 in the event that 110 volt AC power is unavailable, such as, for example, during a power failure.

A microcontroller 250 is located proximate to battery 241 underneath rail assembly 110. Microcontroller 250 controls the operation of motors 134, 134' to power forks 114, 116 up and down rails 110, 112, respectively. When forks 114, 116 are in motion, a buzzer 252 provides an audible indication that lift 100 is in use. Motor 134' on rail assembly 112 is a slave to motor 134 on rail assembly 110, meaning that control signals are sent from controller to motor 134 and motor 134' follows operation of motor 134 to move fork 116 in conjunction with fork 114.

A wireless remote device 260 is operatively connected to microcontroller 250 via radio frequency signals. Remote device 260 includes directional controls to operate motors 134, 134' to raise or lower forks 114, 116 along rails 110, 112, respectively, and to move rail 112 between the operating and stowed positions.

Optionally, low voltage lights (not shown) can be spaced along rails 110, 112 and forks 114, 116 to visually alert a person to the existence and location of lift 100, even in darkness. Such lights, if used, can be electrically connected to battery 250.

In an exemplary use, with rail 110 fixedly mounted to stairs 50 along wall 52, rail 112 can be located on stairs 50 in a stowed position alongside rail 110. When a user desires to operate lift 110, the user, using remote device 260, transmits a signal to motor 228 to move rail 112 to an operation position. As rail 112 is moving, rail 112 engages limit switch 242, indicating that rail 112 has traveled a desired distance, and motor 228 stops.

The user then rolls his/her wheelchair 54 onto forks 114, 116 and over speed bumps 172, 174 until rear wheels 58 are between the two speed bumps 172. Using remote control 260, the user then operates forks 114, 116 up or down rails 110, 112, respectively, depending on where the user is located (at top of stairs 50 or at bottom of stairs 50). To operate forks 114, 116, motors 134, 134' operate, rotating gear 122 along rack 120, and moving forks 114, 116 along rack 120.

As forks 114, 116 near the end of rack 120, sensor 212 is engaged by fork 114, which transmits a signal to motors 134, 134', slowing down operation of motors 134, 134' and preparing to stop motors 134, 134'. As forks 114, 116 reach the end of rack 120, sensor 210 is engaged by fork 114, stopping motors 134, 134'. The user can then wheel wheelchair 54 off forks 114, 116, and off lift 100. After the user exits lift 100, using remote control 260, the user can transmit a signal to motor 228 to slide rail 112 to the stowage position alongside rail 110.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A modular wheelchair lift comprising:

a first rail adapted to be fixedly mounted on a flight of stairs, the first rail having a first top end and a first bottom end;

a second rail extending parallel to the first rail, the second rail being adjustably mounted on the flight of stairs, the second rail having a second top end and a second bottom end;

a first fork movable along the first rail between the first top end and the first bottom end;

a second fork movable along the second rail between the second top end and the second bottom end; and a screw assembly coupled to the second rail, the screw assembly being adapted to slide the second rail alternatively toward and away from the first rail;

such that, as the first fork moves along the first rail between the first top end and the first bottom end, the second fork moves along the second rail between the second top end and the second bottom end.

2. The modular wheelchair lift according to claim 1, wherein each of the first top end of the first rail and the second top end of the second rail comprises a ramp attached thereto.

3. The modular wheelchair lift according to claim 1, further comprising a foot having a base engaging portion coupled to the first rail and a stair engaging portion pivotally coupled to the base engaging portion, the stair engaging portion adapted to engage a stair of the flight of stairs.

4. The modular wheelchair lift assembly according to claim 1, further comprising a first motor coupled to the first fork, the first motor engaged with the first rail to move the first fork along the first rail between the first top end and the first bottom end.

5. The modular wheelchair lift assembly according to claim 4, wherein the first rail comprises a first toothed rack and wherein the first motor comprises a gear rotatably engaged with the first toothed rack.

6. The modular wheelchair lift assembly according to claim 1, further comprising a tie rod having a first end coupled to the first fork and a second end slidably coupled to the first rail.

7. The modular wheelchair lift according to claim 1, wherein the first rail comprises a channel, and wherein the first fork comprises a bearing surface slidably retained within the channel.

8. The modular wheelchair lift according to claim 1, wherein the first fork comprises a free end and wherein the free end includes a wheel stop.

9. The modular wheelchair lift according to claim 8, wherein the biased positive stop comprises an upper plate pivotally coupled to the first fork between a downward position when the first fork is at the first bottom end and an upward position when the first fork is not at the first bottom end.

10. The modular wheelchair lift according to claim 1, further comprising a limit switch mounted on the screw assembly such that, when the second rail has traveled a predetermined distance relative to the first rail, the second rail engages the limit switch to stop operation of the screw assembly.

11. The modular wheelchair lift according to claim 1, wherein the first rail comprises a top face having a plurality of longitudinal slots formed therein and a rack fixedly attached to the top face adjacent one of the plurality of longitudinal slots.

12. A modular wheelchair lift comprising:

a first side having:

a first rail adapted to be fixed to a flight of stairs, the first rail having a first toothed rack;

a first fork slidingly coupled to the first rail, the first fork adapted to receive a first wheel of a wheelchair; and a first motor having a toothed gear output, the first motor being coupled to the first fork and the toothed gear output being in rotational engagement with the first toothed rack such that rotation of the toothed gear output along the rack translates the first fork along the first rail; and a second side extending parallel to the first side, the second side having:

a second rail adapted to engage the flight of stairs, the second rail having a second toothed rack;

a second fork slidingly coupled to the second rail, the second fork adapted to receive a second wheel of the wheelchair;

a second motor having a toothed gear output, the second motor being coupled to the second fork and the toothed gear output being in rotational engagement with the second toothed rack such that rotation of the toothed gear output along the rack translates the second fork along the second rail; and a screw assembly coupled to the second rail, the screw assembly being configured to move the second rail along the flight of stairs between a first position adjacent to the first rail assembly and a second position, distal from the first rail assembly.

13. The modular wheelchair lift according to claim 12, wherein the second side is slidable on the flight of stairs relative to the first side.

14. The modular wheelchair lift according to claim 12, wherein the screw assembly motor comprises a screw motor operable to move the second rail between the first and second position.

15. The modular wheelchair lift according to claim 14, wherein the screw assembly further comprises a limit switch such that, when the limit switch is engaged, the screw motor stops moving the second rail.

16. The modular wheelchair lift according to claim 14, further comprising a controller operatively connected to the screw motor to move the second rail between the first position and the second position.

17. The modular wheelchair lift according to claim 16, further comprising a first motor coupled to the first fork and a second motor connected to the second fork, the first motor and the second motor being operatively connected to the controller.

* * * * *